US006901776B2

(12) United States Patent
Wallis

(10) Patent No.: US 6,901,776 B2
(45) Date of Patent: Jun. 7, 2005

(54) METHOD OF KNITTING AN ELASTOMERIC YARN INTO A CIRCULARLY KNITTED FABRIC

(75) Inventor: Steven Wallis, Nottingham (GB)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/925,311

(22) Filed: Aug. 24, 2004

(65) Prior Publication Data

US 2005/0076682 A1 Apr. 14, 2005

Related U.S. Application Data

(63) Continuation of application No. 10/379,635, filed on Mar. 5, 2003, now Pat. No. 6,810,694.

(51) Int. Cl.[7] ..... D04B 9/00
(52) U.S. Cl. ..... 66/8; 66/146
(58) Field of Search ..... 66/146, 125 R, 66/8, 133, 132 T, 132 R, 131

(56) References Cited

U.S. PATENT DOCUMENTS

| | | | | |
|---|---|---|---|---|
| 3,552,149 A | | 1/1971 | Lonati | 66/14 |
| 3,745,793 A | * | 7/1973 | Heinig et al. | 66/146 |
| 4,339,932 A | | 7/1982 | Lonati | 66/28 |
| 4,407,145 A | | 10/1983 | Lonati | 66/14 |
| 4,454,729 A | | 6/1984 | Lonati | 66/28 |
| 4,516,410 A | | 5/1985 | Lonati et al. | 66/14 |
| 4,625,528 A | * | 12/1986 | Dalmau Guell | 66/132 T |
| 5,050,405 A | * | 9/1991 | Jacobsson | 66/132 R |
| 5,284,033 A | | 2/1994 | Lonati et al. | 66/149 S |
| 5,761,931 A | | 6/1998 | Lonati et al. | 66/148 |
| 5,931,023 A | * | 8/1999 | Brach et al. | 66/136 |
| 6,089,048 A | | 7/2000 | Lonati et al. | 66/134 |
| 6,094,945 A | | 8/2000 | Lonati et al. | 66/146 |
| 6,122,939 A | | 9/2000 | Lonati et al. | 66/145 R |
| 6,339,943 B2 | | 1/2002 | Bertini et al. | 66/149 R |

* cited by examiner

*Primary Examiner*—Danny Worrell
(74) *Attorney, Agent, or Firm*—Ohlandt, Greeley Ruggiero & Perle L.L.P.

(57) ABSTRACT

A method for circularly knitting an elastomeric yarn into a knitted fabric is provided. The method includes: operating a circular knitting machine at a machine rate, retaining a free end of the elastomeric yarn in a substantially relaxed condition, and taking up the free end into the circular knitting machine while feeding the elastomeric yarn at a first feed rate. The first feed rate maintains the elastomeric yarn in the substantially relaxed condition. The circular knitting machine continues to operate at the machine rate during the taking up of the free end.

16 Claims, 3 Drawing Sheets

METHOD OF KNITTING AN ELASTOMERIC YARN INTO A CIRCULARLY KNITTED FABRIC

CROSS REFERENCE TO RELATED APPLICATIONS

This application is a continuation of application Ser. No. 10/379,635 filed Mar. 5, 2003, now U.S. Pat. No. 6,810,694.

BACKGROUND OF THE INVENTION

1. Field of the Invention

The present invention is related to a method for knitting an elastomeric yarn into a circularly knitted fabric.

2. Description of Related Art

It is highly desirable to incorporate elastomeric yarns into knitted fabrics intended for the creation of garments. For example, the elastomeric yarn can provide a degree of elasticity to the knitted fabric, which is useful in many garments such as socks, brassieres, panties, underwear, bathing suits, leotards, and the like.

Generally, incorporating such yarns into a knitted structure as knitted stitches, as opposed to laying-in the yarn, is difficult due to the need to knit these yarns under tension. Further, incorporating such yarns into a knitted structure as knitted stitches is particularly difficult when using circular knitting machines such as those commercially available from Santoni S.p.A. (e.g., Santoni's SM8 knitting machine).

A prime difficulty arises at the start and finish of the knitting process when the elastomeric yarn is introduced and subsequently taken out of the knitting sequence. This difficulty arises from the fact that at the finish of a knitting sequence, the elastomeric yarn has to be severed, but held under tension in readiness for reintroduction at the start of the next knitting sequence.

Prior suction holding mechanisms for nonelastomeric yarns have not proven effective for elastomeric applications. In addition, prior mechanical clamping or holding systems for holding severed elastomeric yarns have proven to be overly expensive and complex.

Difficulties are also encountered in reliably introducing the elastic yarn into the needles for take-up at the start of a knitting sequence. In order to compensate for this difficulty, it is common to slow the speed of the knitting machine. Slowing the knitting machine allows the elastic yarn to be effectively incorporated into the fabric, which has not been possible at normal machine speeds where the elastic yarn tends to pull free from the fabric.

In view of these difficulties, it is common practice to either only introduce bare elastomeric yarn at the beginning of a knitting cycle and knit bare elastomeric yarn throughout the entire cycle, or to have reduced productivity as a result of the slowed machine speeds.

However, there is a continuing desire for apparatus and methods that can provide for the selective elastomeric yarn knitting, while addressing one or more of the aforementioned deficiencies of the prior art.

SUMMARY OF THE INVENTION

It is an object of the present invention to provide a method for introducing elastomeric yarns into a knitting cycle in a more reliable manner than previously possible.

It is another object to provide a method for selectively knitting elastic yarns during selected parts of a knitting cycle.

These and other objects of the present invention are provided by a method for circularly knitting an elastomeric yarn into a knitted fabric. The method includes: operating a circular knitting machine at a machine rate, retaining a free end of the elastomeric yarn in a substantially relaxed condition, and taking up the free end into the circular knitting machine while feeding the elastomeric yarn at a first feed rate. The first feed rate maintains the elastomeric yarn in the substantially relaxed condition. The circular knitting machine continues to operate at the machine rate during the taking up of the free end.

A method of knitting an elastomeric yarn with a circular knitting machine is also provided by the present invention. The method includes initiating a first and a second knitting stage. The first knitting stage maintains the elastomeric yarn in a substantially relaxed condition while maintaining a free end of the elastomeric yarn in a desired position. The second knitting stage causes the circular knitting machine to take up the elastomeric yarn in the substantially relaxed condition by positively feeding the elastomeric yarn at a first feed rate. The circular knitting machine maintains the desired machine rate during the take up of the elastomeric yarn.

It is a further object of the present invention to provide a method for knitting elastomeric yarn on a circular knitting machine to produce knitted stitches of the elastomeric yarn. The method includes: retaining a free end of the elastomeric yarn in a substantially relaxed condition in readiness for introduction to needles of the circular knitting machine; introducing the free end for take-up by the needles; feeding the elastomeric yarn at a first feed rate sufficient to maintain the substantially relaxed condition of the free end during take-up by the needles; feeding the elastomeric yarn at a second feed rate to cause tension in the elastomeric yarn to be raised to a desired level during continued knitting; feeding the elastomeric yarn at a third feed rate to cause the elastomeric yarn to be regain the substantially relaxed condition; severing the elastomeric yarn to define a new tail; and retaining the new tail in the relaxed condition.

The above-described and other features and advantages of the present invention will be appreciated and understood by those skilled in the art from the following detailed description, drawings, and appended claims

DETAILED DESCRIPTION OF THE INVENTION

Figure 1:
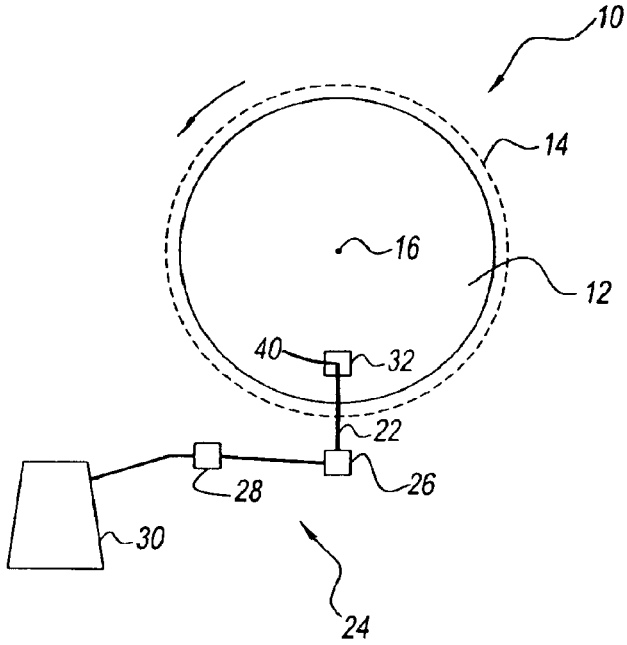
FIG. 1 is a top view of an exemplary embodiment of a circular knitting machine according to the present invention.
Figure 2:
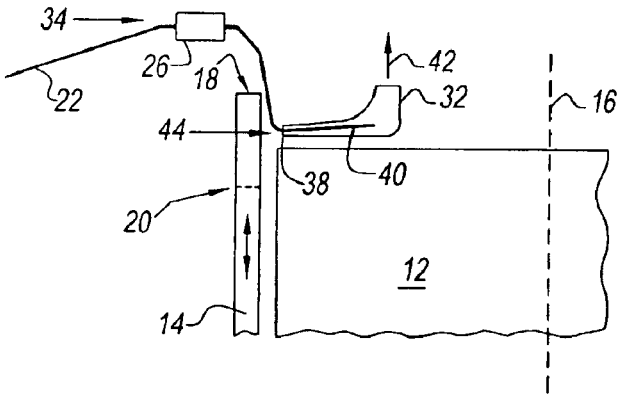
FIG. 2 is a first side view of the machine of FIG. 1.
Figure 3:
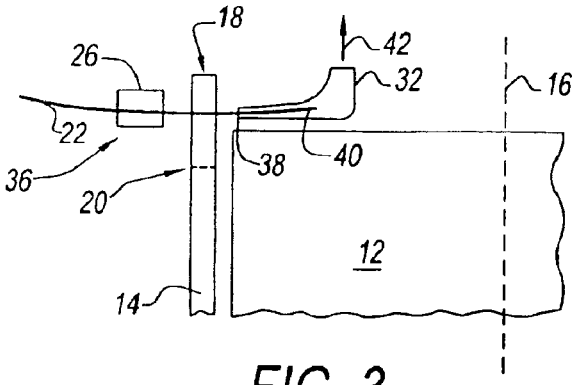
FIG. 3 is a second side view of the machine of FIG. 1.

Referring now to she drawings and in particular to FIGS. 1 through 3, a circular knitting machine generally indicated by reference numeral 10 is illustrated. Circular knitting machine 10 has a cylinder or base 12 with a plurality of needles 14 disposed about its periphery. Machine 10 rotates needles 14 about a central axis 16 while reciprocating the needles between an upper position 18 and a lower position 20 as illustrated in phantom in FIGS. 2 and 3. Thus, machine 10 moves and reciprocates needles 14 to perform a knitting operation according to known principles.

Machine 10 can also receive one or more elastomeric yarns 22 from a feeding system 24. For purposes of clarity, machine 10 is illustrated receiving only one elastomeric yarn 22 from one feeding system 24. Of course, it is contemplated for machine 10 to have more than one feeding system, and for at least some of the feeding systems to feed more than one yarn to machine 10.

Feeding system 24 has a guide 26, a drive 28, a spool or supply of yarn 30 (hereinafter "supply"), and a suction hood 32.

Drive 28 pulls yarn 22 from supply 30, and feeds the yarn to guide 26. For example, drive 28 can be a servo-motor, a stepper motor, or any such motor. Preferably, drive 28 is an Elan2 (RTM). Drive 28 can be controlled by a programmable controller (not shown) of machine 10. Alternately, drive 28 can be controlled by a programmable controller separate from, but in communication with, the controller of machine 10.

Guide 26 is movable by machine 10 between a first position 34 (FIG. 2) and a second position 36 (FIG. 3). When guide 26 is in first position 34, it prevents yarn 22 from being taken-up by needle 14. First position 34 of guide 26 holds yarn 22 out of reach of needle 14, regardless of whether the needle is in its upper or lower position 18, 20, respectively. For example, first position 34 of guide 26 can hold yarn 22 above needle 14 as illustrated.

However, guide 26 moves yarn 22 into the path of needle 14 when the guide is in its second position 36, which allows the yarn to be taken-up by the needle. Second position 36 of guide 26 holds yarn 22 such that needle 14 takes-up the yarn when the needle is in its upper position 18. For example, second position 36 of guide 26 can hold yarn 22 at or below needle 14 in its upper position 18 as illustrated.

Movement of guide 26 between first and second positions 34, 36 is illustrated by way of example only as being parallel to central axis 16. Of course, it is contemplated by the present invention that guide 26 be movable either normal to central axis 16 or a combination of both parallel and normal to the central axis.

Suction hood 32 is disposed on base 12 in a position opposed to guide 26. Suction hood 32 has a suction port 38, which pulls a free end 40 of yarn 18 into the hood through the suction port. For example, suction hood 32 can evacuate air 42 to cause a negative pressure condition within the hood. The negative pressure within suction hood 32 draws air 44 into the hood at suction port 38. The flow of air 44 into suction hood 32 pulls free end 40 into suction port 38 and, thus, maintains the free end in a desired location on base 12.

Preferably, suction port 38 and guide 26 are radially aligned with respect to one another. In this configuration, free end 40 of yarn 22 is maintained in an optimal position with respect to needles 14 to ensure reliable introduction into the needles, when required. Preferably, suction hood 32 maintains free end 40 radially aligned with respect to the central axis 16 and perpendicular to the direction of travel of needles 14.

The interaction of feeding system 24 with machine 10 is described in its various stages with reference to FIGS. 4 through 8.

Figure 4:
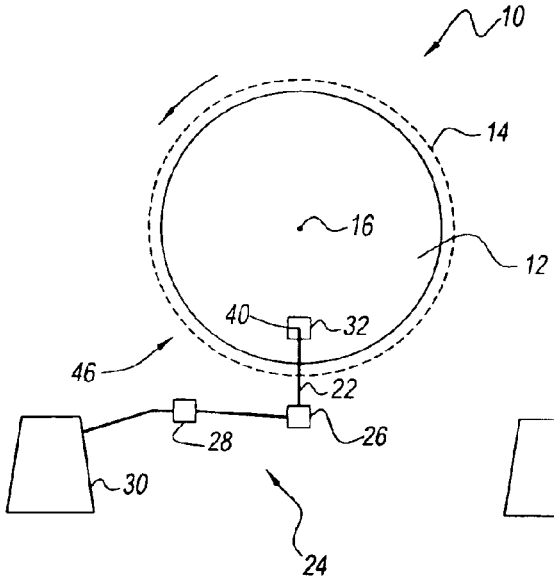
FIGS. 4 through 8 schematically illustrate various stages of a knitting process according to the present invention.

In FIG. 4, machine 10 is performing a first stage 46 of a knitting process, which does not include the knitting of elastomeric yarn 22. Here, base 12 is rotating and needles 14 are reciprocating such that other yarns (not shown for purposed of clarity) are being knitted in a known manner. Thus, machine 10 is operating at a desired machine rate.

During first stage 46, drive 28 is not pulling yarn 22 from supply 30. Free end 40 of the yarn is held in the desired position by suction hood 32, while guide 26 is at its first position 34 such that yarn 22 is maintained out of reach of needles 14. Accordingly, yarn 22 between drive 28 and free end 40 is in a substantially relaxed or slack condition, with the only tension being applied by the degree of suction applied by suction hood 32. However, the amount of tension applied by suction hood 32 is sufficient to maintain free end 40 in the desired position relative to base 12. Thus, feeding system 24 maintains yarn 22 for introduction into the knitting process, when desired.

First stage 46 outlined above may be considered to be a passive phase of the process, i.e. during this phase the elastomeric yarn is static and held in readiness for introduction into the knitting process.

Figure 5:
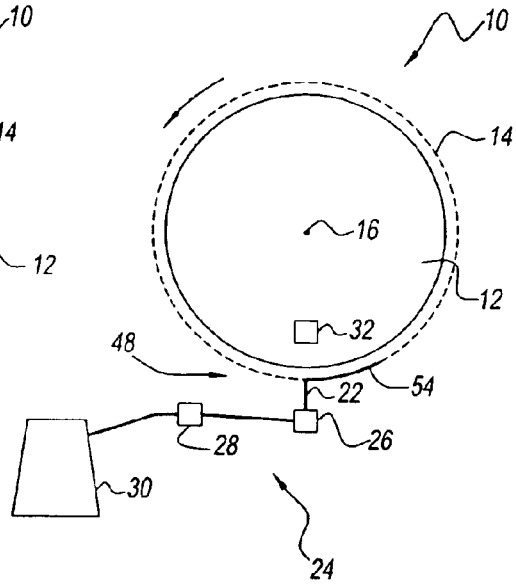

A second stage 48 of the knitting process is illustrated in FIG. 5. This is the beginning of the active phase of the process, i.e. the phase during which actual knitting of elastomeric yarn 22 is performed.

In second stage 48, elastomeric yarn 22 is introduced to needle 14 for knitting, i.e. the second stage is the initial take-up of elastomeric yarn. In the second stage 22, guide 26 is moved to its second position 36 to bring yarn 22 into the path of needles 14.

Prior to free end 40 being taken-up by needle 14, drive 28 is controlled to positively feed yarn 22 at a first feed rate. Preferably, drive 28 is controlled to begin positively feeding yarn 22 before or as guide 26 is moved to its second position 36.

The first feed rate is selected to maintain yarn 22 at the substantially relaxed or slack condition as it is taken up by needle 14. Thus, the first feed rate of drive 28 feeds yarn 22 at a rate substantially equal to the rate with which machine 10 is drawing the yarn into the machine. The rate with which machine 10 draws yarn 22 into the machine can depend on the machine rate and other factors, such as, but not limited to, the size and rate of rotation of base 12, the number of needles 14, and others. Moreover, the first feed rate of drive 28 compensates for the elastic properties of yarn 22 as it is taken up by needle 14.

Figure 8:
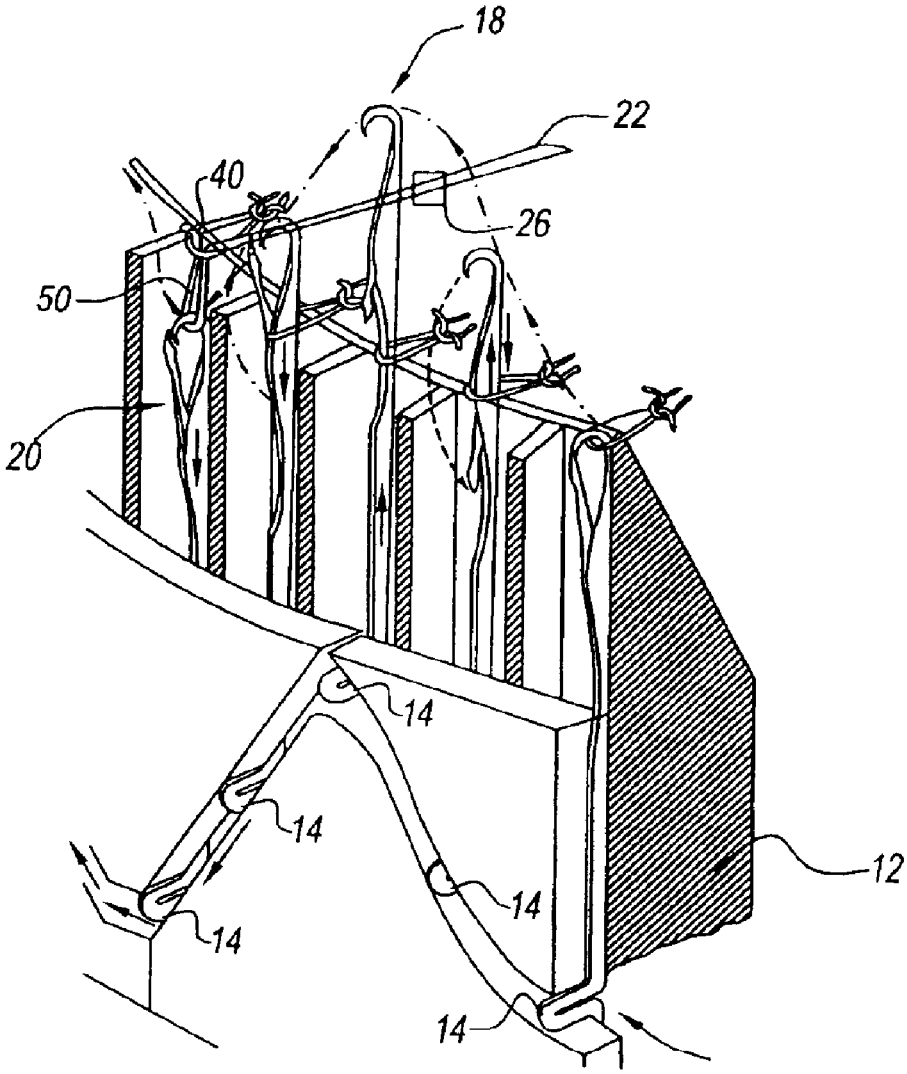

Drive 28 continues to feed yarn 22 at the first feed rate until at least one needle 14 descends to lower position 20, allowing a knitted stitch 50 to be formed as illustrated in FIG. 8. Knitted stitch 50 secures free end 40 in the resultant knitted fabric. For purposes of clarity, various components of feeding system have not been is illustrated in FIG. 8.

Figure 6:
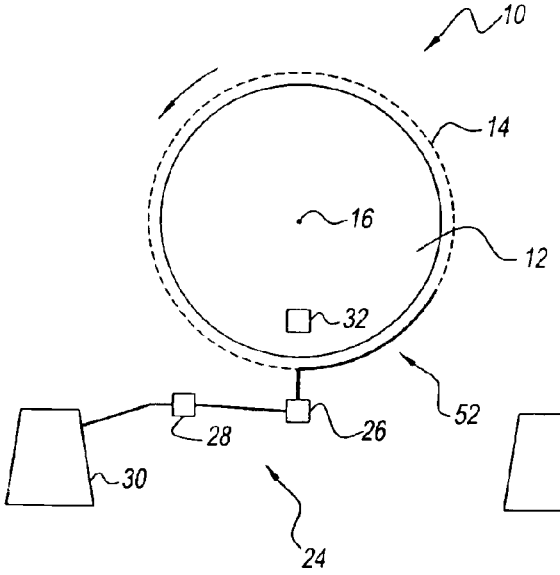

A third stage 52 of the knitting process is illustrated in FIG. 6. Third stage 52 represents the "normal" knitting phase of the process whereby yarn 22 is knitted into the resultant knitted fabric at a desired pretensioned or stretched condition.

In order to provide yarn 22 with the pretensioned condition in the resultant knitted fabric, drive 28 is controlled to positively feed yarn 22 at a second feed rate. The second feed rate is slower than the first feed rate and, thus, feeds yarn 22 at a rate slower than the rate with which machine 10 is drawing the yarn into the machine. In this manner, the second feed rate causes a rise in the tension of elastomeric yarn 22 between drive 28 and needles 14 to a desired "knitting" tension.

The knitting tension can be varied in yarn 22 by varying the second feed rate with respect to the rate with which machine 10 is drawing the yarn into the machine. Accordingly, the second feed rate can be a constant feed rate or can be a variable feed rate, to provide the desired knitting tension, which itself can be constant or variable within the garment.

Since third stage 52 increases the tension in yarn 22, it is preferably initiated after the yarn has been knitted or trapped within a sufficient number of knitted stitches 50 so as to prevent free end 40 from being pulled from needles 14 upon application of the knitting tension. Thus, drive 28 is controlled to initiate third stage 52 after sufficient needles 14 have taken-up yarn 22 and moved to lower position 18. This is indicated diagrammatically in FIG. 5 as a distance 54. Preferably, third stage 52 is initiated at a predetermined time delay from commencement of second stage 48.

Figure 7:
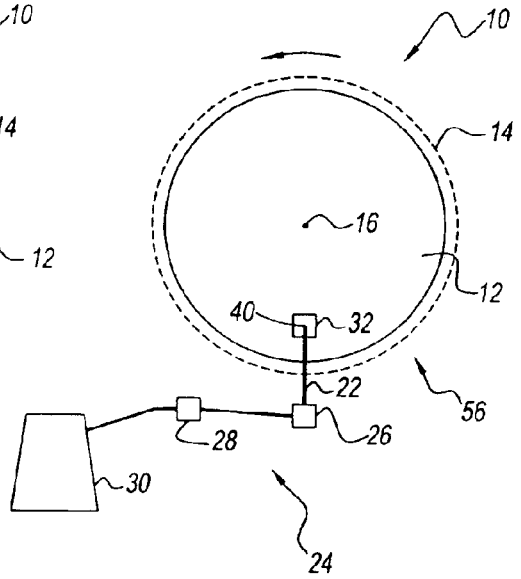

In order to stop knitting of elastomeric yarn 22, it is necessary to sever the yarn with a cutter (not shown) of machine 10. However, severance of yarn 22 can not be performed while the yarn is under its knitting tension; to do so would cause the yarn to elastically recover to its relaxed condition, causing the yarn to unthread from guide 26 so that it is not captured by suction hood 32. Thus, a fourth stage 56 of the knitting process, illustrated in FIG. 7, is provided.

In fourth stage 56, drive 28 is controlled to positively feed yarn 22 at a third feed rate. The third feed rate is chosen to maintain yarn 22 at the substantially relaxed or slack condition as it is taken up by needle 14. Thus, the third feed rate of drive 28 feeds yarn 22 at a rate substantially equal to the rate with which machine 10 is drawing the yarn into the machine and at a rate that compensates for the knitting tension induced in the resultant fabric.

Accordingly, at the time when machine 10 severs yarn 22, to create a new free end 40, the yarn between drive 28 and suction hood 32 has already elastically recovered to its substantially relaxed state. Thus, due to its relaxed state, yarn 22 does not retract to unthread itself from guide 26 when severed, but instead is drawn into suction hood 32. Substantially simultaneous with the severing of yarn 22, fourth stage 56 controls drive 28 to stop positively feed yarn 22, i.e. it is switched off, while guide 26 is moved back to its first position 34. The knitting process has now progressed back into the passive phase (first stage 46) and is ready for the next knit or knitting cycle.

First through fourth stages 46, 48, 52, and 56 can be repeated as desired within the same garment. Thus, a resultant garment can be provided by the method and apparatus of the present invention that has elastomeric yarns selectively incorporated therein. Importantly, positively feeding elastic yarn 22 into machine 10 allows the yarn to be incorporated into the resultant fabric while maintaining (e.g., without slowing) the machine rate of machine 10.

The above method and apparatus are described by example only in relation to operation on an electronically controlled circular knitting machine having a plurality of yarn feeds around a needle cylinder. A suitable machine is a SM8 Santoni knitting machine; of course, other circular knitting machines are contemplated for use with the present invention. For such a machine, it is envisaged that each feed station would be provided with its own suction hood 32 and its own feeding system 24.

It should also be noted that the terms "first", "second", "third", "upper", "lower", and the like may be used herein to modify various elements. These modifiers do not imply a spatial, sequential, or hierarchical order to the modified elements unless specifically stated.

While the present invention has been described with reference to one or more exemplary embodiments, it will be understood by those skilled in the art that various changes may be made and equivalents may be substituted for elements thereof without departing from the scope of the present invention. In addition, many modifications may be made to adapt a particular situation or material to the teachings of the present invention without departing from the scope thereof. Therefore, it is intended that the present invention not be limited to the particular embodiment(s) disclosed as the best mode contemplated for carrying out this invention, but that the present invention will include all embodiments falling within the scope of the appended claims.

What is claimed is:

1. A circular knitting machine comprising:

a plurality of needles moving a substantially constant knitting speed;

a drive for positively feeding an elastomeric yarn to said plurality of needles, said drive being operable at a first feed rate;

a guide being movable with respect to said plurality of needles, said guide preventing said elastomeric yarn from being taken-up by said plurality of needles in a first position and allowing said elastomeric yarn to be taken-up by said plurality of needles in a second position; and a controller for controlling said drive and said guide, said controller moving said guide from said first position to said second position while operating said drive at said first feed rate, wherein said first feed rate is substantially equal to or greater than a rate with which said elastomeric yarn is drawn-in by said plurality of needles while moving at said substantially constant knitting speed.

2. The machine as in claim 1, wherein said controller controls said drive to operate at said first feed rate until at least one needle of said plurality of needles knits a stitch.

3. The machine as in claim 1, wherein said drive is operable at a second feed rate, said second feed rate being less than said rate with which said elastomeric yarn is drawn-in by said plurality of needles.

4. The machine as in claim 3, wherein said second feed rate is a constant feed rate or a variable feed rate.

5. The machine as in claim 1, wherein said drive is a servo-motor or a stepper motor.

6. The machine as in claim 1, further comprising a severing device controlled by said controller to sever said elastomeric yarn from said plurality of needles.

7. The machine as in claim 6, wherein said controller operates said drive at said first feed rate for a predetermined period of time prior to controlling said severing device to sever said elastomeric yarn.

8. The machine as in claim 6, further comprising a suction hood on said cylinder, said suction hood generating a negative pressure sufficient to maintain a severed end of said elastomeric yarn in a desired location on said cylinder.

9. The machine as in claim 1, further comprising a suction hood disposed on said cylinder, said suction hood generating a negative pressure sufficient to maintain a severed end of said elastomeric yarn in a desired location on said cylinder.

10. A yarn feeding system for a circular knitting machine, comprising:

a drive for positively feeding an elastomeric yarn to the circular knitting machine, said drive being operable at a first feed rate;

a guide being movable with respect to the circular knitting machine, said guide for preventing said elastomeric yarn from being taken-up by the circular knitting machine in a first position and allowing an end of said elastomeric yarn to be taken-up by the circular knitting machine in a second position;

a suction hood for generating a negative pressure sufficient to maintain said end in a desired location on the circular knitting machine during movement of said guide; and a controller for controlling said drive and said guide, said controller moving said guide from said first position to said second position while operating said drive at said first feed rate, wherein said first feed rate is substantially equal to or greater than a rate with which said elastomeric yarn is drawn-in by the circular knitting machine.

11. The system as in claim 10, wherein said controller controls said drive to operate at said first feed rate until the circular knitting machine knits at least one stitch.

12. The system as in claim 10, wherein said drive is operable at a second feed rate, said second feed rate being less than said rate with which said elastomeric yarn is drawn-in by the circular knitting machine.

13. The system as in claim 12, wherein said second feed rate is a constant feed rate or a variable feed rate.

14. The system as in claim 10, wherein said drive is a servo-motor or a stepper motor.

15. The system as in claim 10, further comprising a severing device controlled by said controller to sever said elastomeric yarn from the circular knitting machine.

16. The system as in claim 15, wherein said controller operates said drive at said first feed rate for a predetermined period of time prior to controlling said severing device to sever said elastomeric yarn.

* * * * *